US009625855B2

(12) United States Patent
Ota

(10) Patent No.: US 9,625,855 B2
(45) Date of Patent: Apr. 18, 2017

(54) DEVELOPER CONTAINER, IMAGE FORMING UNIT AND IMAGE FORMING APPARATUS

(71) Applicant: Oki Data Corporation, Minato-ku, Tokyo (JP)

(72) Inventor: Atsushi Ota, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/860,394

(22) Filed: Sep. 21, 2015

(65) Prior Publication Data

US 2016/0216638 A1 Jul. 28, 2016

(30) Foreign Application Priority Data

Jan. 22, 2015 (JP) ..... 2015-010041

(51) Int. Cl.
*G03G 21/12* (2006.01)
*G03G 15/08* (2006.01)

(52) U.S. Cl.
CPC ..... *G03G 15/0865* (2013.01); *G03G 21/12* (2013.01)

(58) Field of Classification Search
CPC ..... G03G 2215/0685; G03G 21/12; G03G 15/0834; G03G 15/0832; G03G 15/0868
See application file for complete search history.

(56) References Cited

U.S. PATENT DOCUMENTS

2014/0079438 A1* 3/2014 Abler ..... G03G 15/0875 399/262
2015/0185660 A1* 7/2015 Shibata ..... G03G 15/0865 399/262

FOREIGN PATENT DOCUMENTS

JP 2003345116 A 12/2003

OTHER PUBLICATIONS

Kato, JP 2003-345116, JPO abstract (2003).*

* cited by examiner

*Primary Examiner* — Sevan A Aydin
(74) *Attorney, Agent, or Firm* — Panitch Schwarze Belisario & Nadel LLP

(57) ABSTRACT

A developer container according to the invention includes a developer containing unit, a partition member, and a moving restricting member. The developer containing unit has a developer containing chamber for containing an unused developing agent and a waste developer containing chamber for containing a waste developing agent. The partition member partitions the developer containing chamber and the waste developer containing chamber. The moving restricting member permits the partition member moving from a side of the waste developer containing chamber to a side of the developer containing chamber and restricts the partition member moving from the side of the developer containing chamber to the side of the waste developer containing chamber.

16 Claims, 15 Drawing Sheets

DEVELOPER CONTAINER, IMAGE FORMING UNIT AND IMAGE FORMING APPARATUS

CROSS REFERENCE TO RELATED APPLICATION

This application claims priority benefits under 35 USC, section 119 on the basis of Japanese Patent Application No. 2015-010041, the disclosure of which is incorporated herein by reference.

BACKGROUND OF THE INVENTION

1. Field of the Invention

This invention relates to a developer container for containing developer, an image forming unit having the developer container, and an image forming apparatus having the developer container.

2. Description of Related Art

In image forming apparatuses such as photocopiers and printers utilizing electrophotographic method, some toner cartridge has been known as a replaceable developer container for supplying toner to a developing device as well as simultaneously used for collecting waste toner. For example, a structure has been known in which an interior of one toner cartridge is divided by a transformable partition member, and in which one section of the cartridge contains unused toner whereas the other section of the cartridge collects waste toner. The partition member is transformed according to pressure of the stored waste toner, thereby reducing a container volume of the unused toner, and increasing a container volume of the waste toner.

With such a toner cartridge, the space of the toner cartridge can be reduced because the container volumes can be turned over between the unused toner and the waste toner before and after the use. The partition member, however, may move toward a side of a chamber for containing the waste toner.

SUMMARY OF THE INVENTION

With one aspect of the invention, it is an object to provide a restriction against move of the partition member.

In accordance with a first aspect of the invention, a developer container includes a developer containing unit, a partition member, and a moving restricting member. The developer containing unit has a developer containing chamber for containing an unused developing agent and a waste developer containing chamber for containing a waste developing agent. The partition member partitions the developer containing chamber and the waste developer containing chamber. The moving restricting member permits the partition member moving from a side of the waste developer containing chamber to a side of the developer containing chamber and restricts the partition member moving from the side of the developer containing chamber to the side of the waste developer containing chamber.

These and other objects, features, aspects and advantages of the disclosed disc brake caliper will become apparent to those skilled in the art from the following detailed description, which, taken in conjunction with the annexed drawings, discloses preferred embodiments.

BRIEF DESCRIPTION OF THE DRAWINGS

Referring now to the attached drawings which form a part of this original disclosure.

DETAILED DESCRIPTION OF EMBODIMENTS

First Embodiment

Figure 1:
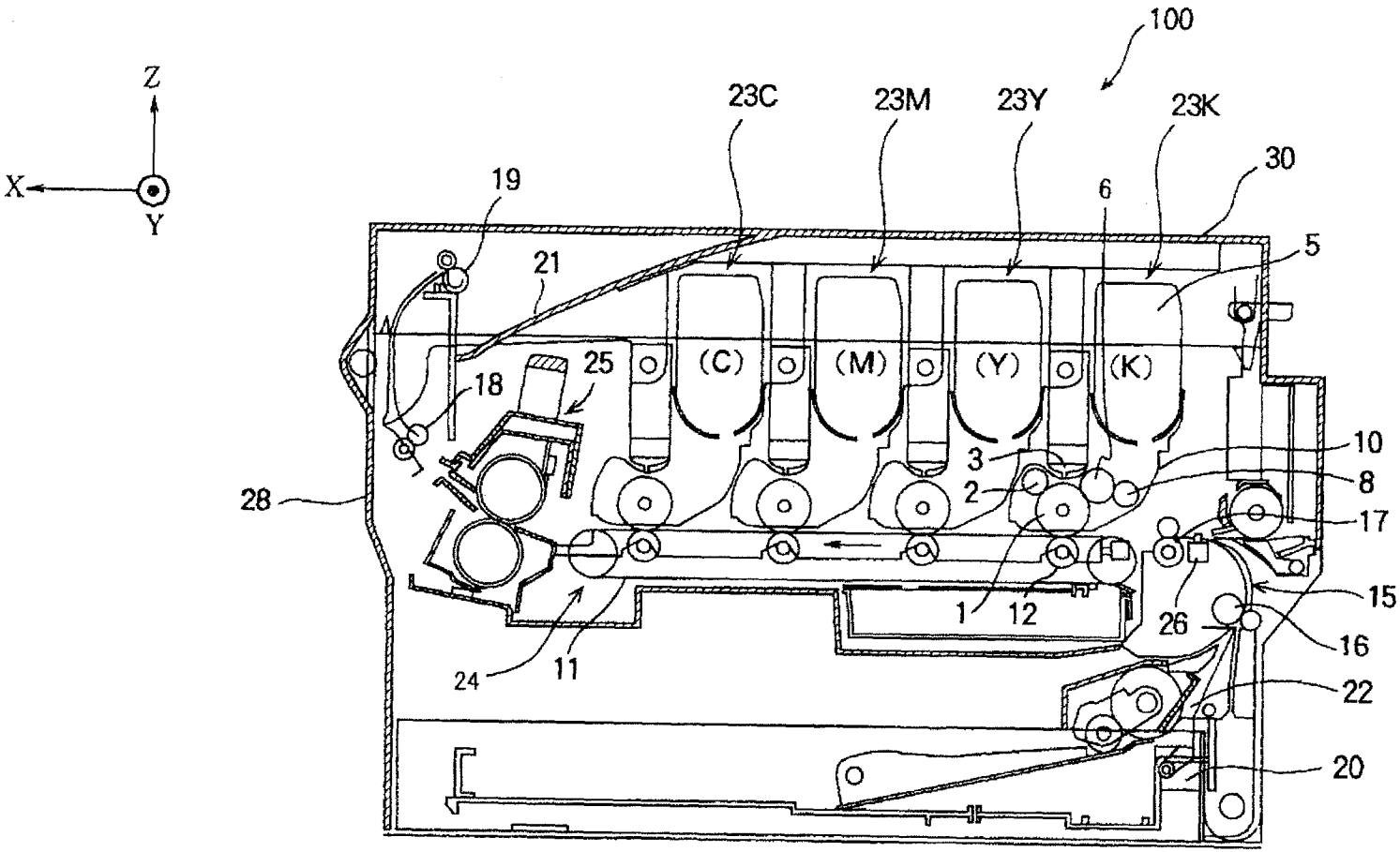
FIG. 1 is a structural diagram showing an essential structure of an image forming apparatus according to a first embodiment of the invention.

Hereinafter, embodiments according to the invention are described in detail with reference to the drawings. FIG. 1 is a structural diagram showing an essential structure of an image forming apparatus according to a first embodiment of the invention.

In FIG. 1, an image forming apparatus 100 has a structure as a multicolor electrophotographic printer capable of printing four colors, black (K), yellow (Y), magenta (M), and cyan (C). A paper conveyance route 15 substantially in a letter-S shape is formed having paper conveyance rollers 16 to 19 at a lower frame 28. A feeding cassette 20 is disposed at an end on an upstream side for containing recording paper, and a stacker 21 is arranged at an end on a downstream side, The paper conveyance route 15 is formed with a paper feeding unit 22 for feeding recording paper out of the feeding cassette 20, a detection unit 26 for detecting a paper thickness of the recording paper, a transfer belt unit 24 conveying the fed recording paper in attaching the paper to a transfer belt 11 with an electrostatic effect, and a fixing device 25 fixing toner images onto the recording paper.

Image forming units 23K, 23Y, 23M, 23C (or simply 23 when no need for distinguishing each unit) containing toners in black (K), yellow (Y), magenta (M), and cyan (C) are arranged in a line sequentially from an upstream side in the conveyance direction of the recording paper in a manner detachable from the image forming apparatus body at positions sandwiching, with the transfer belt unit 24, the recording paper conveyed in an arrow direction as attached to the transfer belt 11.

When a top cover 30 of the image forming apparatus 100 is made open, the image forming unit 23, the fixing device 25, and the transfer belt unit 24 can be replaced.

In this embodiment, those image forming units 23K, 23Y, 23M. 23C have the same structure but have the different toner colors, so that the image forming unit 23K for black (K) is exemplified, and the internal structure is described as below.

It is to be noted in FIG. 1 that X-axis is set in the conveyance direction when the recording paper 13 (see FIG. 2) passes by the image forming unit 23, that Y-axis is set in a rotation axis direction of a photosensitive drum 1 described below, and that Z-axis is set in a direction perpendicular to both of those axes. When the X, Y, Z axes are shown in other figures as described below, the directions of those axes indicate the same directions, respectively. That is, the X, Y, Z axes in each figure show layout directions when the illustrated portion in each figure structures the image forming apparatus 100 shown in FIG. 1. It is arranged so that the Z-axis becomes a vertical direction.

Figure 2:
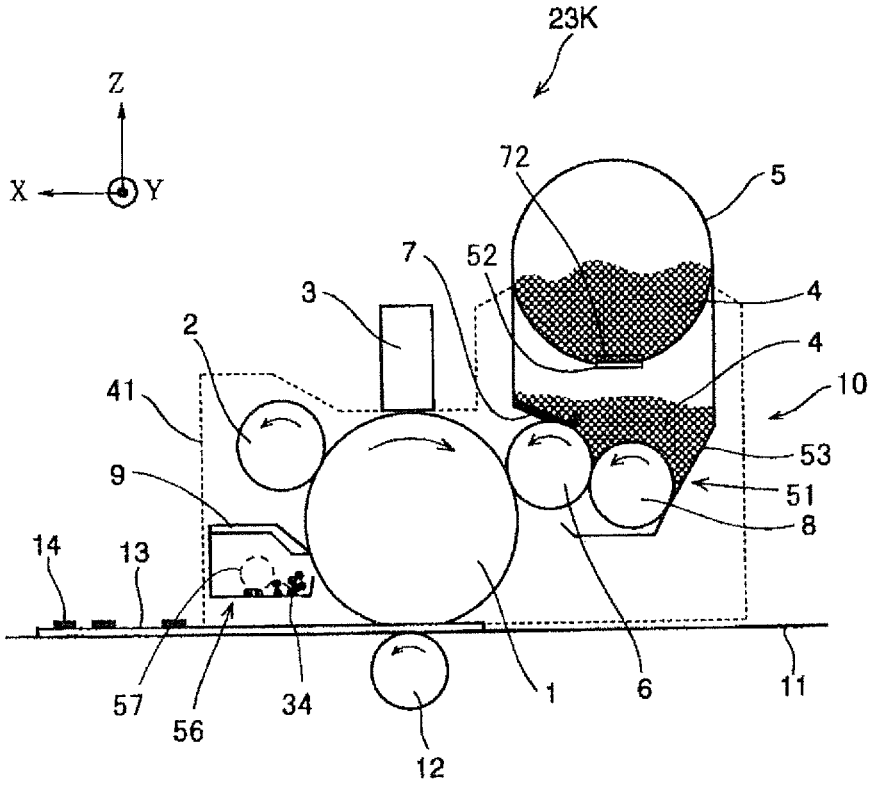
FIG. 2 is a schematic diagram showing an image forming unit for black color (K), a transfer belt, a transfer roller, an exposure device, and printed recording paper according to the first embodiment.

FIG. 2 is a schematic diagram showing the image forming unit 23K for black color (K), the transfer belt 11, a transfer roller 12, an exposure device 3, and printed recording paper 13.

As shown in FIG. 2, the image forming unit 23K is structured of a developing device 10 externally covered with a body casing 41, and a toner cartridge 5 detachably attached to the developing device 10.

The photosensitive drum 1 as an image carrier is disposed at the developing device 10 in a manner rotatable in an arrow direction. The photosensitive drum 1 is formed in a cylindrical shape with a surface accumulating electric charges for carrying electrostatic latent images based on image information, and is formed of a conductive base layer made of such as, e.g., aluminum, and a photosensitive layer made of an organic photosensitive body on a surface of the conductive base layer.

Around the photosensitive drum 1, arranged are, in the order from an upstream side in the rotation direction, a charge roller 2 charging uniformly the surface of the photosensitive drum 1 in supplying electric charges as rotating in pressurized contact with the surface, and the exposure device 3 forming electrostatic latent images upon emitting light from a light source such as, e.g., an LED head. The charge roller 2 is formed of a conductive metal shaft covered with a semiconductive rubber such as silicone rubber, and the exposure device 3 is held at the top cover 30 (see, FIG. 1) on a side of the body of the image forming apparatus 100.

A developing unit 51 generating toner phenomenon upon attaching toner in a prescribed color (it is black here), and a cleaning blade 9 removing waste toner 34 as transfer remaining toner remaining when the toner phenomenon on the photosensitive drum 1 is transferred onto the recording paper 13 and dropping the waste toner into the waste toner collection unit 56, are disposed on the surface of the photosensitive drum 1 on which the electrostatic latent images are formed.

The cleaning blade 9 is therefore formed of an elastic body, and is arranged so that an edge of the blade 9 contacts the surface of the photosensitive drum 1 with constant pressure. Rotary bodies used in respective units are rotatable upon receiving drive force from a drive source not shown via, e.g., gears.

The developing unit 51 contains toner 4 serving as a developing agent, and includes a toner reservoir 53 reserving, via a toner receiving opening 52, the toner 4 supplied from the toner cartridge 5, which delivers the toner 4 from a toner supply opening 72 formed at a lower portion thereof, a developing roller 6 contacting the photosensitive drum 1 with the constant pressure, a toner supply roller 8 supplying the toner 4 to the developing roller 6, and a developing blade 7 making the toner 4 on the developing roller 6 as a thinner layer. The developing roller 6 makes the electrostatic latent images formed on the surface of the photosensitive drum 1 visible, or namely develops the latent images. The toner cartridge 5 is described below in detail.

The developing roller 6 and the toner supply roller 8 are disposed parallel to each other so as to contact each other with constant pressure, and rotate in respective arrow directions shown in FIG. 2 (same direction). The developing blade 7 formed of, e.g., a stainless steel made elastic member in a plate shape and the developing roller 6 are disposed parallel to each other so that a folded portion of the developing blade 7 contacts a circumferential surface of the developing roller 6 with constant pressure as shown in FIG. 2. The rotary bodies used in those units and devices rotate upon receiving drive force from the drive source not shown via, e.g., gears.

The toner cartridge 5 is, as described below, a developer container structured as to contain the toner 4 and also as to be able to contain waste toner as collected waste developing agent. The toner cartridge 5 is disposed above the toner supply roller 27 in a way to be detachably attached to a developing device 31, and is replaceable when the toner 4 is empty or when the waste toner is full.

As shown in FIG. 1, a transfer roller 12 formed of, e.g., a conductive rubber material is provided at a position facing the photosensitive drum 1 of each of the four image forming units 23 in a state that the transfer roller 12 is pressed via the transfer belt 11 conveying the recording paper 13 (see FIG. 2) with electrostatic absorption. Those transfer rollers 12 transfer the toner developments on the photosensitive drums 1 onto the recording paper 13, but at the time of the transfer, a voltage for providing a prescribed potential difference is applied between the surface potential of the respective photosensitive drums 1 and the surface potential of the respective transfer rollers 12 disposed in facing the respective photosensitive drums 1.

The fixing device 25 has inside a heating roller and a backup roller and fixes the transferred toner 14, which is transferred onto the recording paper 13 (see FIG. 2), in application of heat and pressure. The recording paper 13 thus fixed is conveyed to a stacker 21 of the recording paper 13 by means of paper conveyance rollers 18, 19 described below.

Figure 3:
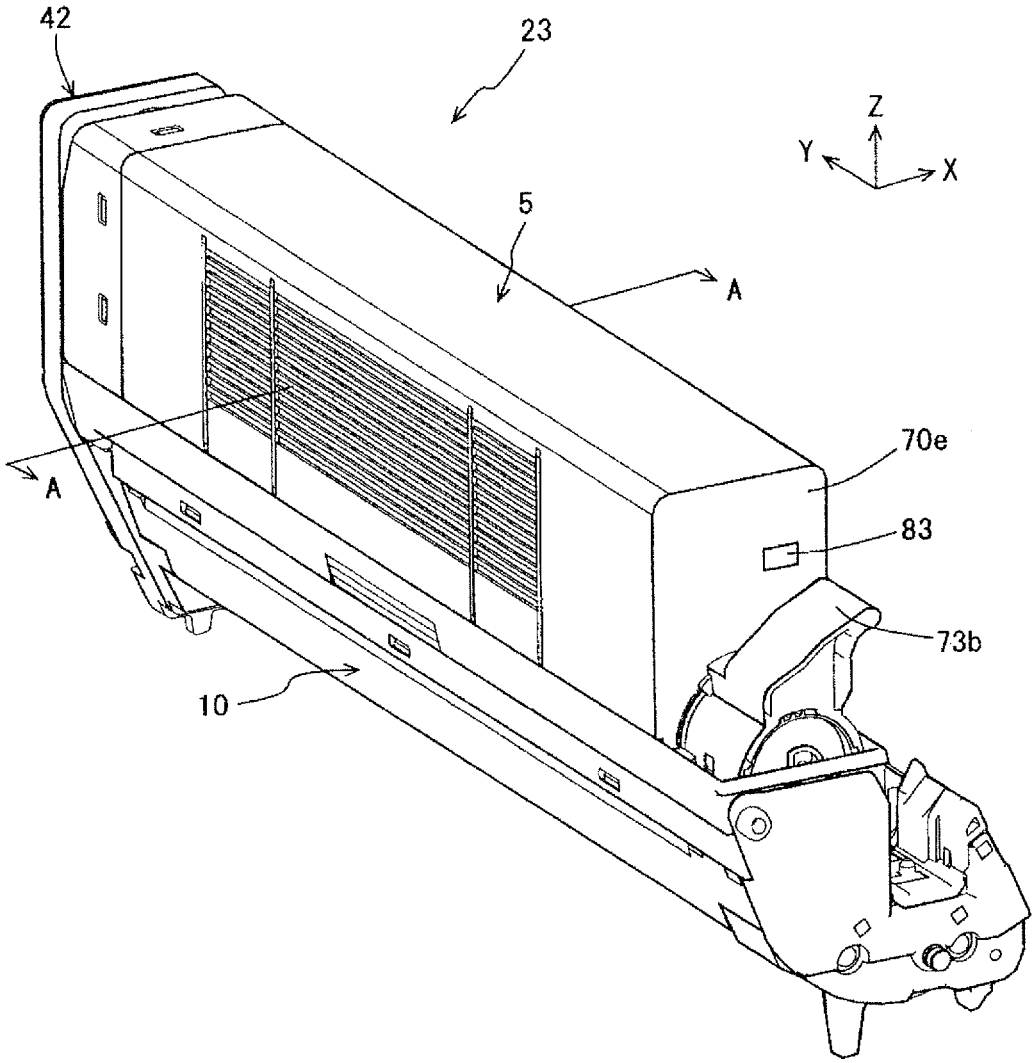
FIG. 3 is an appearance perspective view showing the image forming unit according to the first embodiment.
Figure 4:
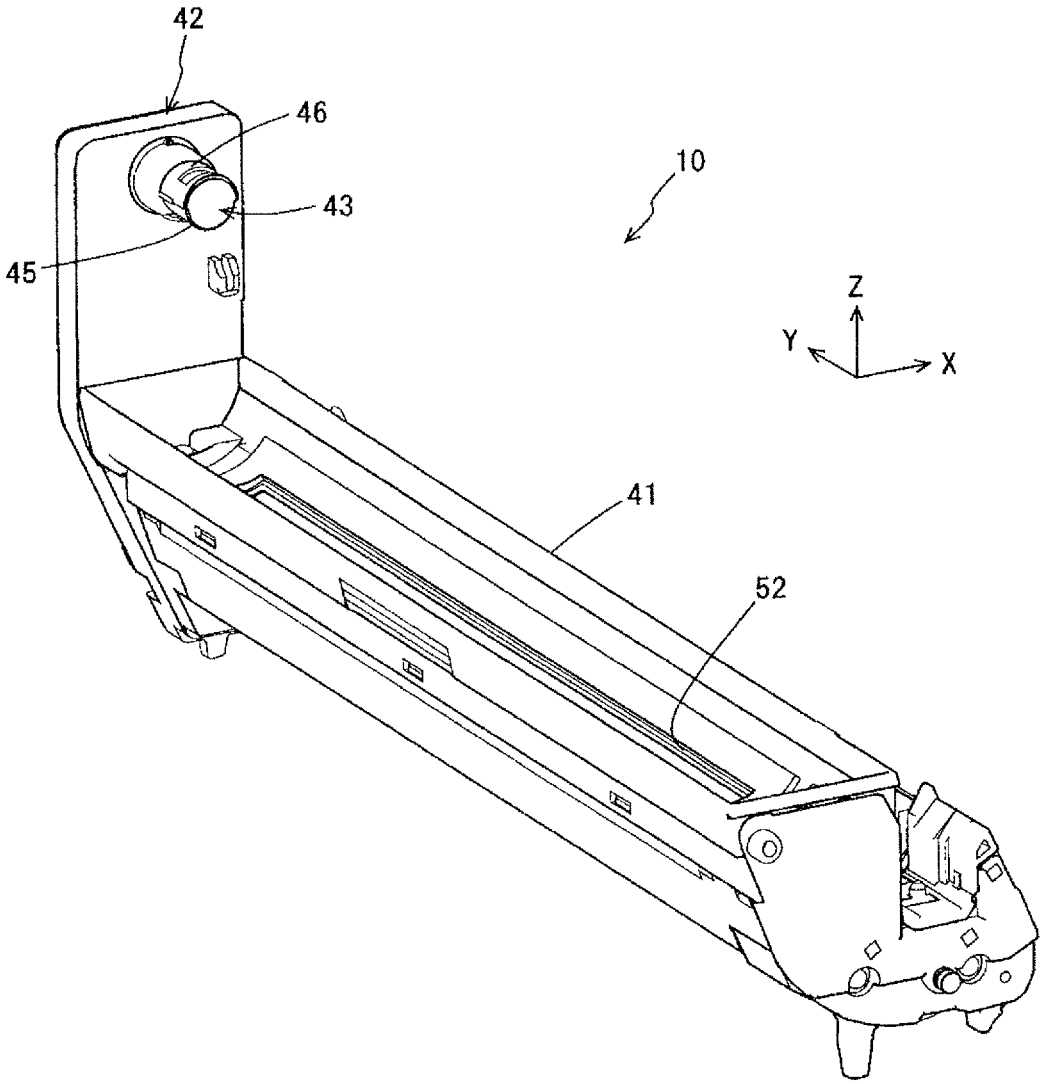
FIG. 4 is an appearance perspective view showing a developing device according to the first embodiment, at which a toner cartridge is removed.
Figure 5:
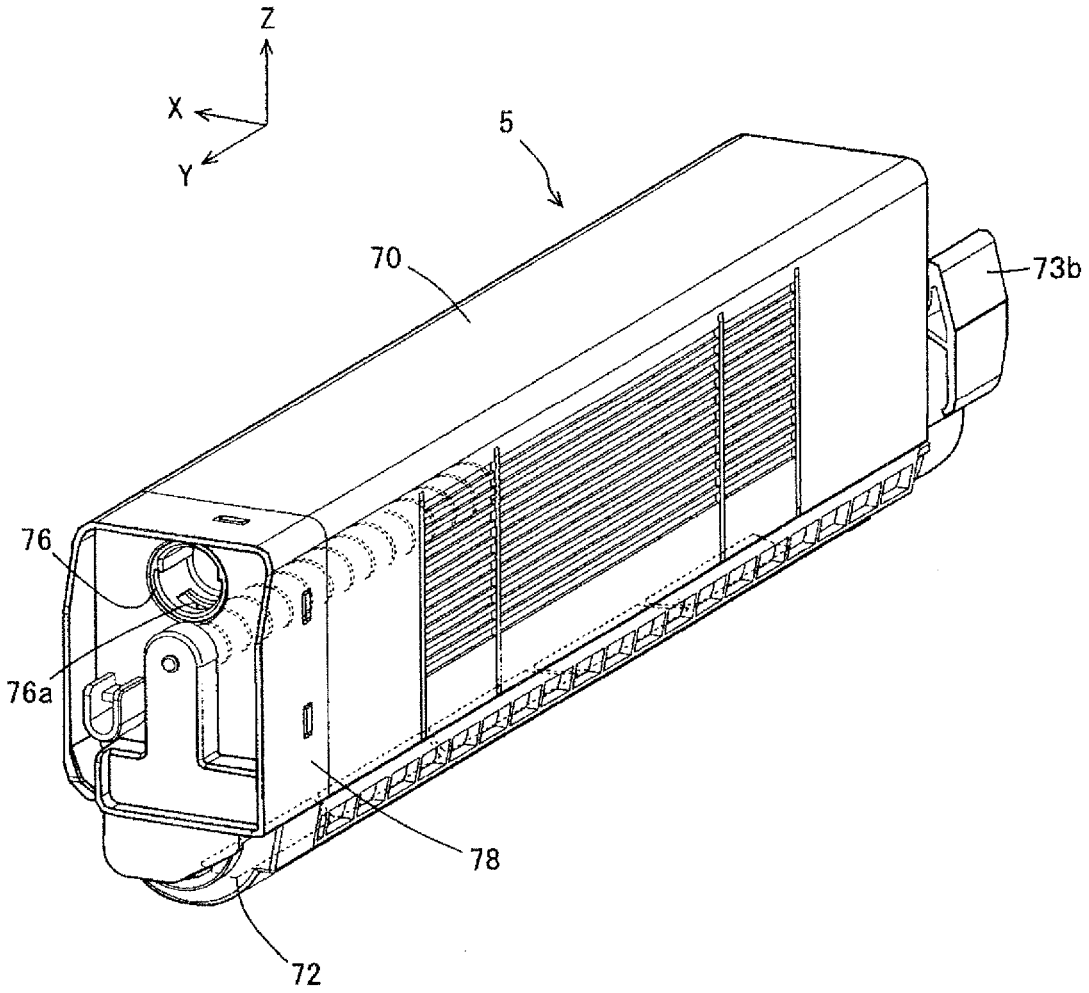
FIG. 5 is an appearance perspective view showing solely a toner cartridge according to the first embodiment of the invention.
Figure 6:
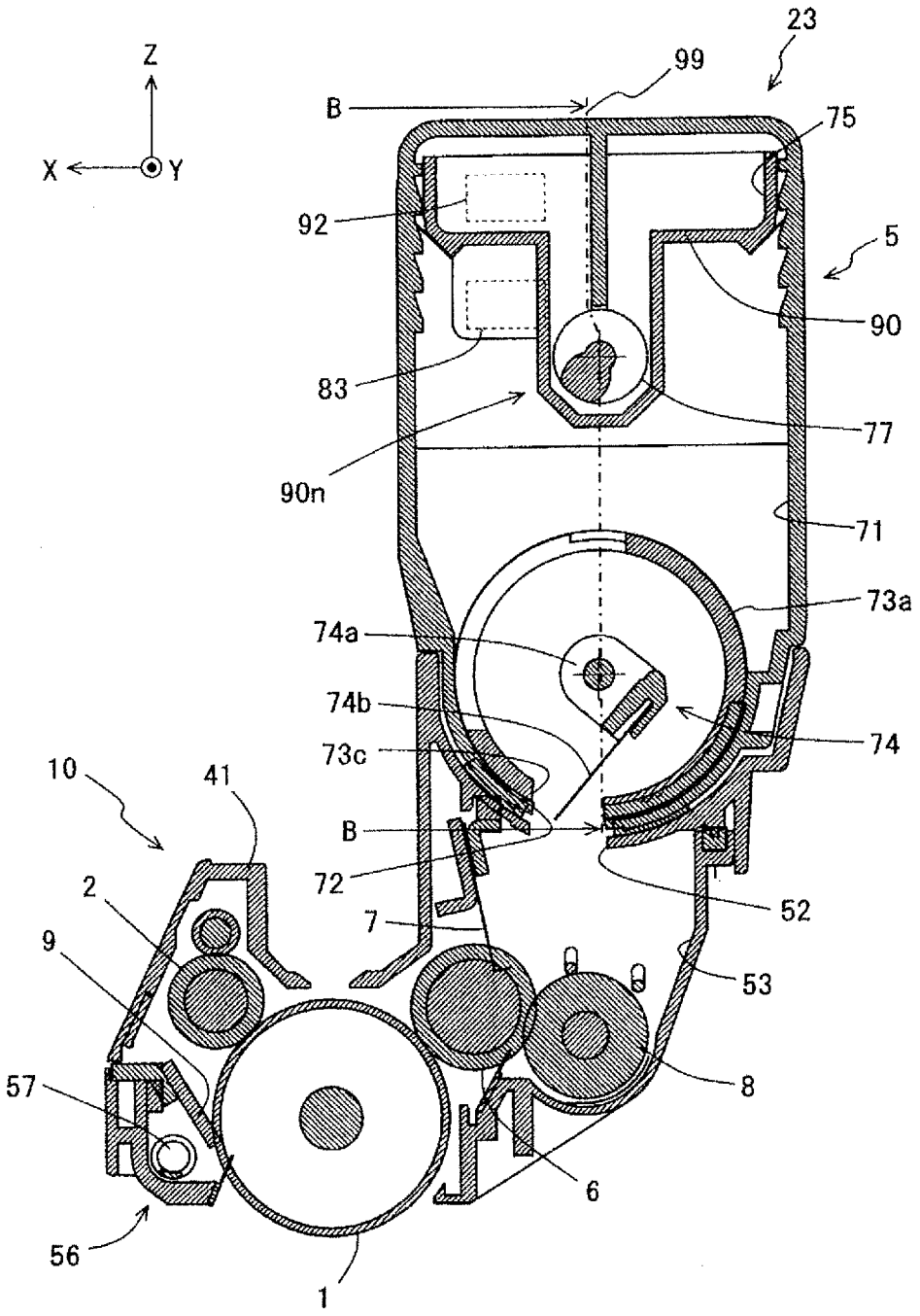
FIG. 6 is a cross section showing the image forming unit, taken along VI-VI line in FIG. 3.

The structure of the image forming unit 23 is described further. FIG. 3 is an appearance perspective view showing the image forming unit 23; FIG. 4 is an appearance perspective view showing the developing device 10 where the toner cartridge 5 is removed; FIG. 5 is an appearance perspective view showing the toner cartridge 5 solely; FIG. 6 is a cross section showing the image forming unit 23 taken along VI-VI line in FIG. 3.

As shown in FIG. 4, the developing device 10 is provided with, e.g., the body casing 41 containing such as, e.g., photosensitive drum 1 (see FIG. 1), the toner receiving opening 52 receiving the toner 4 supplied from the attached toner cartridge 5, a waste toner discharge unit 43 discharging the waste toner 34 inserted into the interior of the attached toner cartridge 5, a waste toner conveyance device 42 receiving the waste toner scraped with the cleaning blade 9 and conveying the waste toner to a waste toner discharge outlet 45 formed at the waste toner discharge unit 43.

In the body casing 41, for example, as shown in FIG. 6, the photosensitive drum 1, the charge roller 2, the toner supply roller 8, the developing roller 6, the developing blade 7, the cleaning blade 9, and the waste toner collection unit 56, described above, are arranged.

The toner receiving inlet 52 is formed in a rectangular shape extending along a longitudinal direction (Y-axis direction) at a top surface of the body casing 41, and is designed to have a formation portion and a shape as to overlap the toner supply opening 72 formed at the toner cartridge 5 when the toner cartridge 5 described below is attached. The toner receiving inlet 52 comes in communication with the toner reservoir 53 and introduces the toner 4 supplied from a toner containing chamber 71 (see FIG. 6) formed inside the toner cartridge 5 as described below into the toner reservoir 53.

The waste toner collection unit 56 includes a spiral shaft or spiral 57 extending in the longitudinal direction (Y-axis direction) inside, and sequentially conveys the waste toner 34 dropped inside in a direction of an end at which the waste toner conveyance device 42 is located. The waste toner conveyance device 42 is arranged over the one end of the body casing 41 (or the plus direction of the Y-axis) and pulls up the conveyed waste toner 34 to a position of the waste toner discharge unit 43 located at an upper portion of the casing using a conveyance belt not shown provided inside, thereby conveying the waste toner to the waste toner discharge outlet 45.

The waste toner discharge unit 43 has an outer shape in a cylindrical shape, and is formed as to project inward from an inner side wall (the minus direction of the Y-axis) at an upper portion of the waste toner conveyance device 42. The waste toner discharge outlet 45 is formed at a bottom in a vertical direction of a cylindrical side or circumferential surface near a tip end of the waste toner discharge unit 43, and a discharge outlet lid 46 is provided slidably along the circumferential surface in the circumferential direction for opening and closing the waste toner discharge outlet 45.

The waste toner discharge unit 43 is fitted into a waste toner intake opening 76 (see FIG. 5) when the toner cartridge 5 is attached to the developing device 10, and discharges the waste toner 34 to a waste toner containing chamber 75 (see, FIG. 6) formed inside the toner cartridge 5 from the waste toner discharge outlet 45.

The discharge outlet lid 46 opens the waste toner discharge outlet 45 when the waste toner discharge unit 43 is fitted into the waste toner intake opening 76, and slides, according to removal of the toner cartridge 5 from the developing device 10, as to close the waste toner discharge outlet 45 when the waste toner discharge unit 43 separates from the waste toner intake opening 76, thereby preventing the waste toner 34 from leaking out of the waste toner discharge outlet 45.

Next, the structure of the toner cartridge 5 is described.

Figure 7:
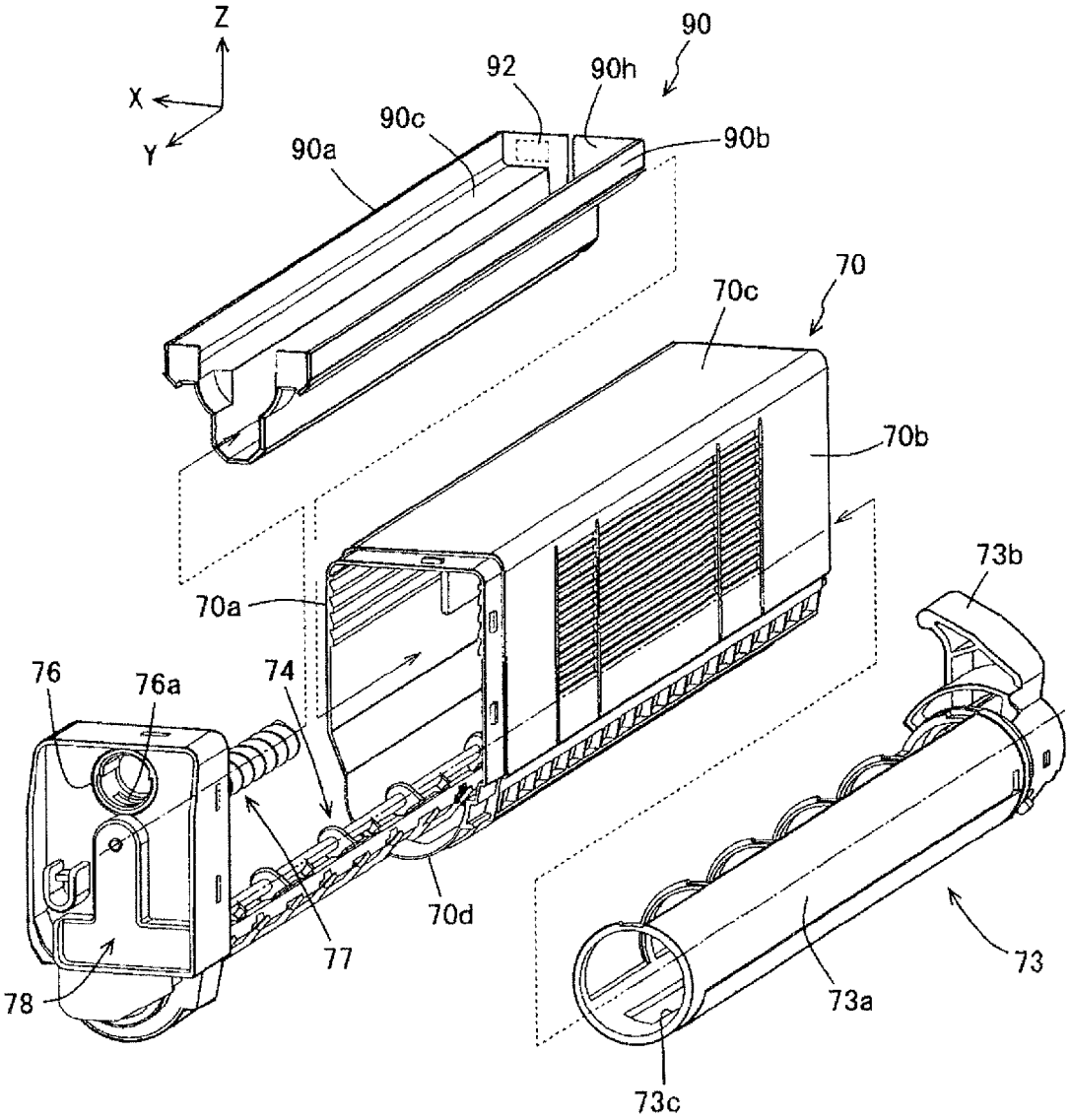
FIG. 7 is an exploded perspective view showing the toner cartridge according to the first embodiment of the invention.
Figure 8:
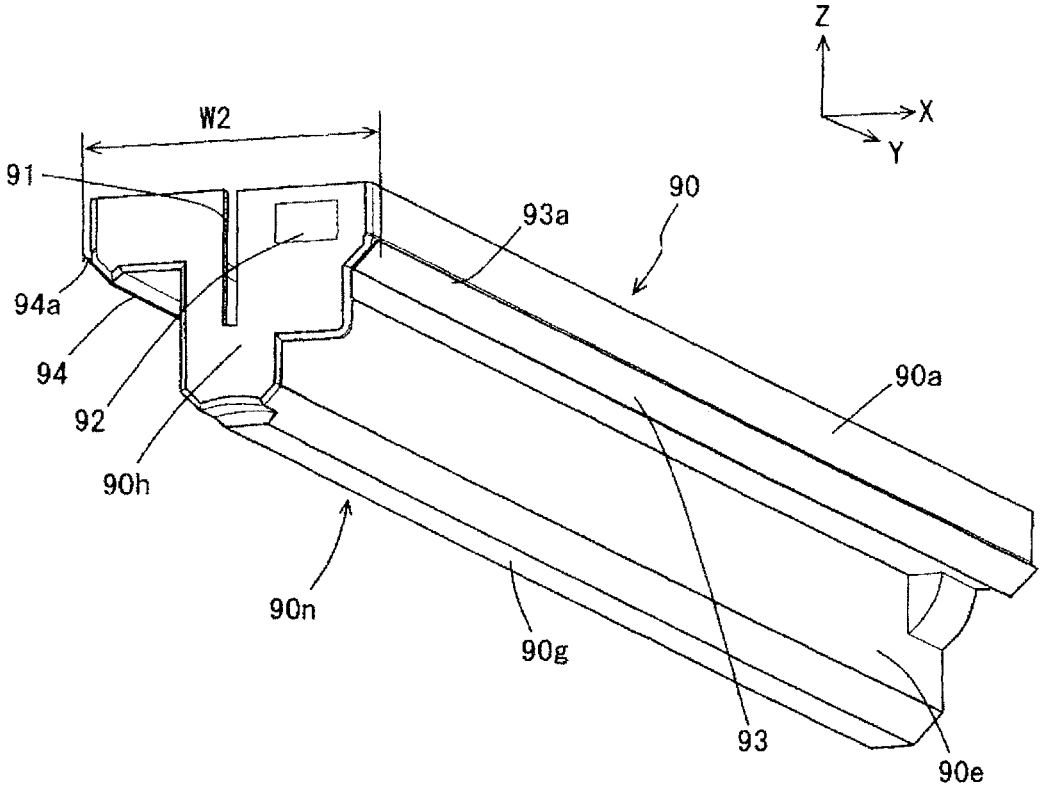
FIG. 8 is an appearance perspective view showing a partition member when viewed from an oblique lower side.
Figure 9:
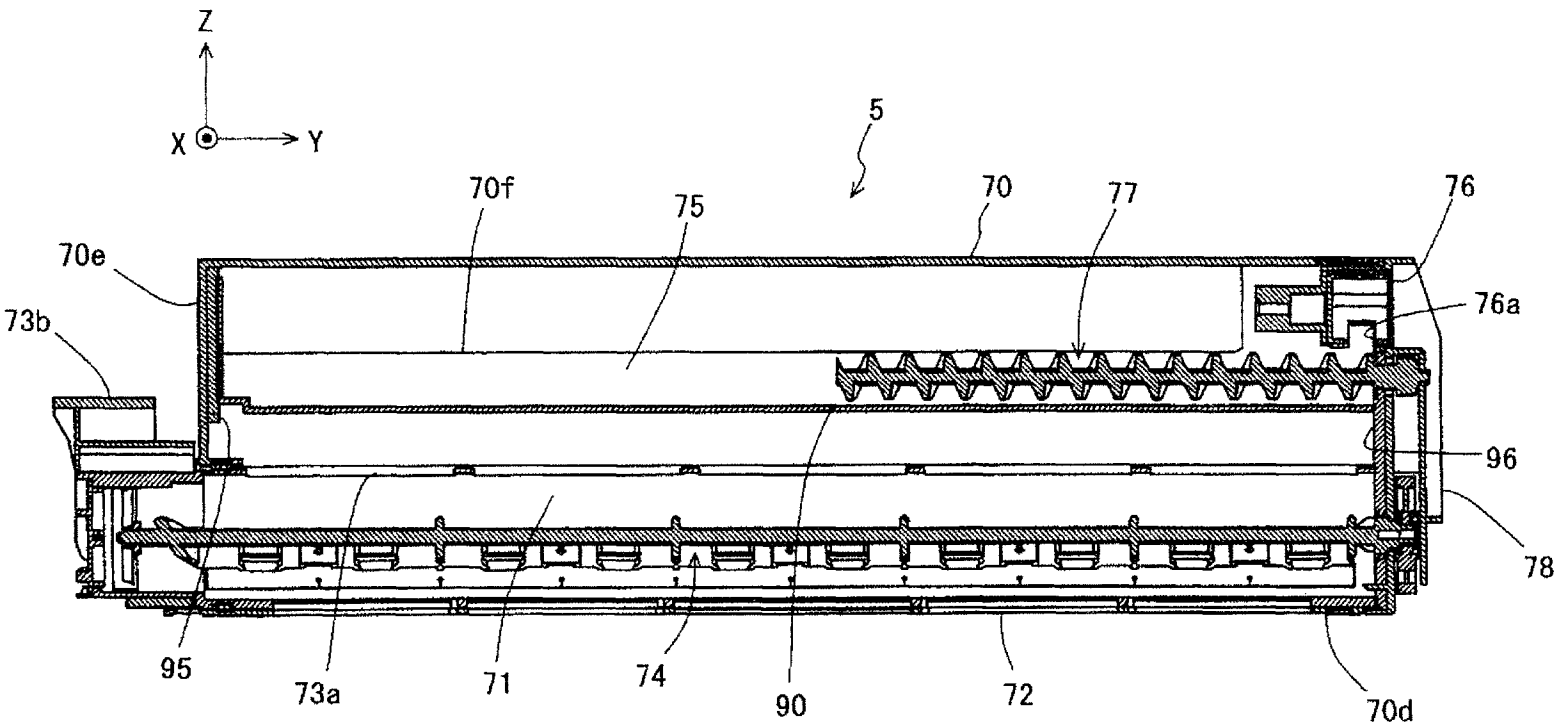
FIG. 9 is a cross section showing the toner cartridge taken along IX-IX line in FIG. 6.
Figure 10:
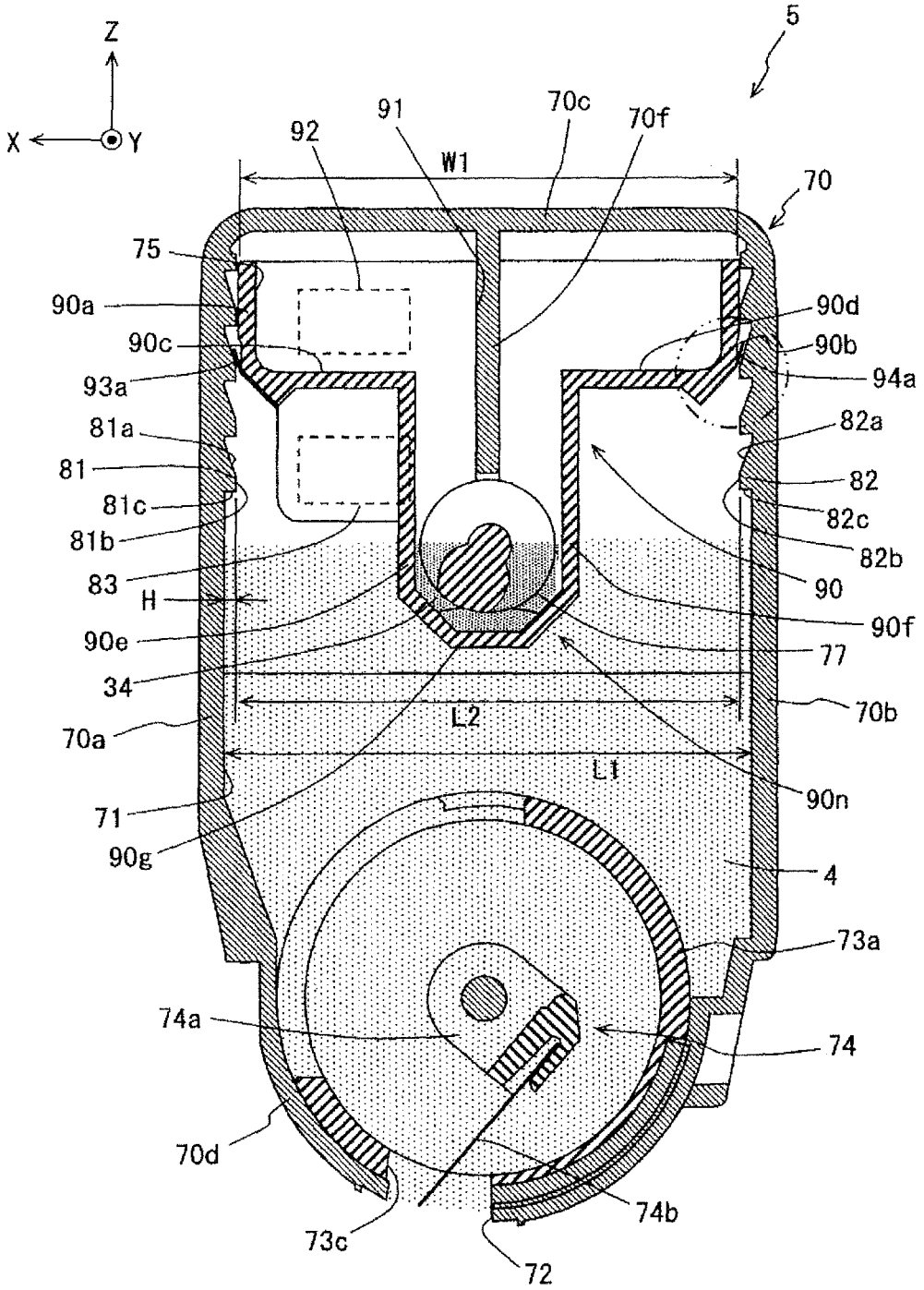
FIG. 10 is a cross section showing the toner cartridge containing toner attached to a developing device, immediately after start of use.
Figure 11:
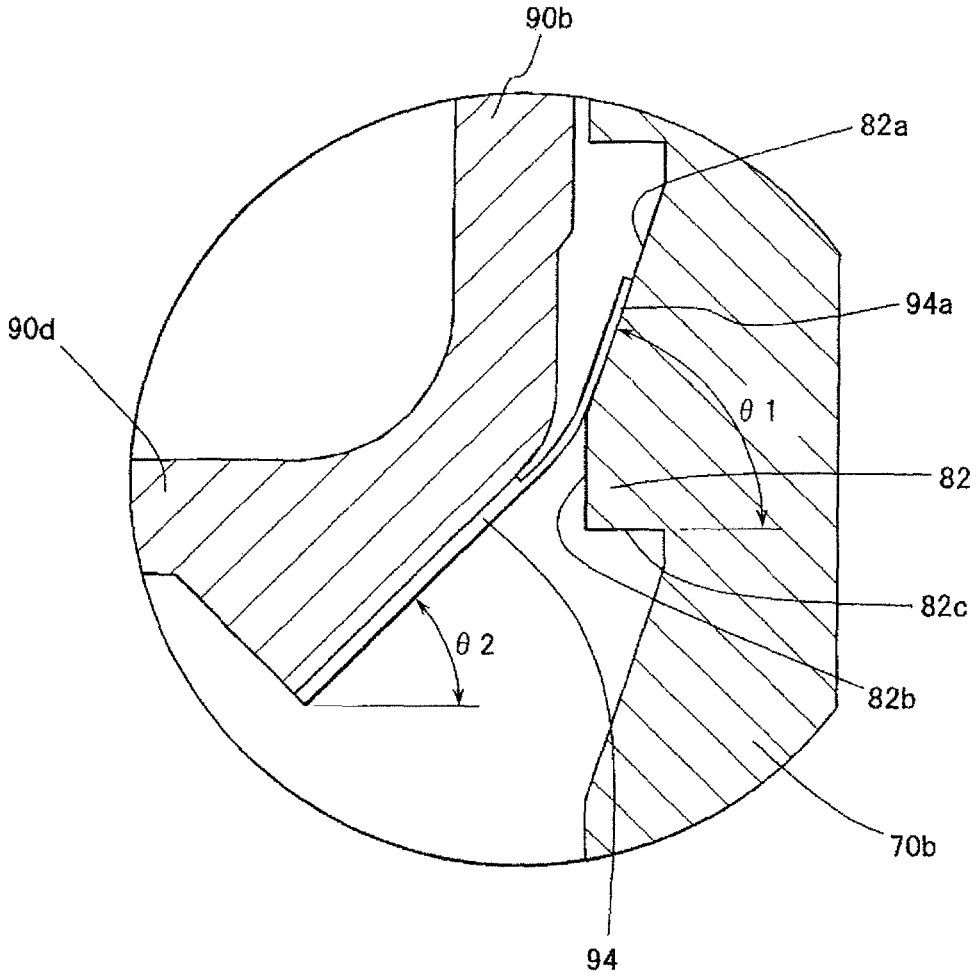
FIG. 11 is an enlarged view showing a portion circled with a double dotted chain line in FIG. 10.

FIG. 6 is a cross section showing the image forming unit 23 taken along VI-VI line in FIG. 3; FIG. 7 is an exploded perspective view showing the toner cartridge 5; FIG. 8 is an appearance perspective view showing solely a partition member 90 when viewed from an oblique lower side; FIG. 9 is a cross section showing the toner cartridge 5 taken along IX-IX line in FIG. 6. FIG. 10 is a cross section showing the toner cartridge 5 containing the toner 4 as a developing agent attached to the developing device 10, immediately after start of use (or printing), at the same position as in FIG. 6; FIG. 11 is an enlarged view showing a portion circled with a double dotted chain line in FIG. 10.

The toner cartridge 5 serving as a developer container includes a container body 70 serving as a part of a developer containing unit, the partition member 90 supported movably only in a downward direction (or gravity force direction) along the inner wall of the container body 70, a toner containing chamber 71 serving as a developer containing chamber, or a first chamber, for containing unused toner 4 formed by means of the partition member 90 at a lower side inside the container body 70, the toner supply opening 72 serving as a developer supply opening for supplying the toner 4 in the toner containing chamber 71 to the developing device 10, a supply opening lever 73 for opening and closing the toner supply opening 72 when attached to the developing device 10, a toner stirring bar 74 stirring the toner 4 in the toner containing chamber 71 and discharging the toner 4 to the interior of the developing device 10 from the toner supply opening 72, and a waste toner containing chamber 75 serving as a waste developer containing chamber, or a second chamber, containing the waste toner 34 as waste developer formed by means of the partition member 90 on an upper side in the container body 70. The toner 4 serves as a first agent contained in a first space in the first chamber, and the waste toner 34 serves as a second agent contained in a second space in the second chamber.

The toner cartridge 5 includes a waste toner intake opening 76 for taking the waste toner 34 from the waste toner discharge outlet 45 (see, FIG. 4) of the developing device 10 to the waste toner containing chamber 75, a dropping opening **76*a* formed in a coupling manner with the waste toner intake opening 76, a waste toner conveyance spiral 77 as a conveyance spiral for conveying the waste toner 34 in the waste toner containing chamber 75, a container side surface lid 78 for shielding side surfaces of the toner containing chamber 71 and the waste toner containing chamber 75 in fitting to the container body 70, and sealing members 95, 96 (see, FIG. 9) for sealing gaps between both side faces of the partition member 90 and inner walls of the container body 70 and the container side surface lid 78 in the longitudinal direction (Y-axis) of the toner cartridge 5**.

It is to be noted that the waste toner intake opening 76 and the dropping opening **76*a* formed in connection with the waste toner intake opening 76 are formed as a waste developer intake opening in the container side surface lid 78, and the container body 70 and the container side surface lid 78** are corresponding to the developer containing unit.

The structures of the respective portions of the toner cartridge 5 are described further. It is to be noted that the longitudinal direction may be defined in a back and forth direction (Y-axis direction) of the toner cartridge 5 because the toner cartridge 5 is formed in extending in the back and forth direction where the back and forth direction of the toner cartridge 5 is specified from a view making the image forming apparatus 100 shown in FIG. 1 is set to a front side (or the minus direction of Y-axis).

As shown in FIG. 3, and FIG. 5 to FIG. 10, the container body 70 is structured with a contour having vertical frames **70*a*, 70*b* located on right and left sides extending in the longitudinal direction as disposed in vertically facing each other, a horizontal frame 70*c* forming a top surface, a bottom 70*d* (see FIG. 7) formed in a cross-sectionally half arc shape engaging with the developing device 10, and a side frame 70*e* (see FIG. 3) on one side in the longitudinal direction (or minus direction of Y axis). The container body 70 has an interior space extending in the longitudinal direction. A transparent window 83 (see FIG. 3) made of a transparent material for transmitting light is formed at a prescribed position in the side frame 70***e* for checking the interior from the outside of the container body 70.

Plural restriction ribs 81 are arranged with prescribed intervals in the vertical direction at an upper side on the inner wall of the left vertical frame 70*a*, serving as serrated portions formed projections extending in the longitudinal direction. Each restriction rib 81, serving as a moving restriction member, is formed with a tip surface 81*b* having a height H, a slope 81*a* as an inclined surface located above the tip surface, and a lower end surface 81*c* extending perpendicularly from a lower end of the tip surface 81*b*.

Similarly, restriction ribs 82 are formed on an inner wall of the right vertical frame 70*b*, each having a slope 82*a*, a tip surface 82*b*, and a lower end surface 82*c*. The restriction ribs 82 serves as a moving restriction member. The restriction rib 81 and the restriction rib 82 are formed symmetrically with respect to a virtual center plane (extending parallel to the Z-Y plane) in a width direction of the toner cartridge 5. Those restriction ribs 81, 82 serve as rack members of a ratchet mechanism to restrict movements of the partition member 90.

As shown in FIG. 10, where a distance between inner surfaces of the right and left vertical frames facing to each other is set to L1, and where a distance between the tip surfaces 81*b*, 82*b* of the right and left vertical frames facing to each other is set to L2, the height H of the restriction rib 81 and the restriction rib 82 is set as follows:

$$H=(L1-L2)/2$$

As shown in FIG. 11, the tip surfaces 81*b*, 82*b* of the restriction ribs 81, 82 are formed extending in the vertical direction, and the slopes 81*a*, 82*a* of the restriction ribs 81, 82 are formed with a slope angle θ1 with respect to a horizontal surface. The slope 81*a* is inclined more to the vertical direction rather than the horizontal plane with respect to the inner wall of the left vertical frame 70*a*, and the slope 82*a* is inclined more to the vertical direction rather than the horizontal plane with respect to the inner wall of the right vertical frame 70*b*.

The partition member 90 is a member partitioning the interior of the container body 70 into the toner containing chamber 71 formed on a lower side and the waste toner containing chamber 75 formed on an upper side. The partition member 90 partitions the spaces of the first and second chambers, and the partition member 90 is movable inside the developer containing unit in a way to decrease the first space and to increase the second space. As shown in FIG. 6, the partition member 90 has a waste toner containing portion having a cross section in substantially letter T shape, and extends in the longitudinal direction of the container body 70 as shown in FIG. 7.

The partition member 90 includes right and left upper side wall portions 90*a*, 90*b* disposed facing the right and left vertical frames 70*a*, 70*b* of the container body 70, right and left bottom portions 90*c*, 90*d* having shallow bottoms extending horizontally in directions closer to each other formed continuously with the lower ends of the right and left upper side wall portions 90*a*, 90*b*, lower side wall portions 90*e*, 90*f* extending downward in facing each other from the tip side of the bottom portions 90*c*, 90*d*, and a bottom 90*g* located at a center in the width direction formed continuously with the lower side wall portions 90*e*, 90*f*. Those portions are extending in the longitudinal direction. It is to be noted that a lower projecting portion formed of the lower side wall portions 90*e*, 90*f* and the bottom 90*g* may be referred to a toner contact portion 90*n*.

An end wall 90*h* is formed at one end (minus side of Y-axis) in the longitudinal direction of the partition member 90. A slit 91 extending downward and a light reflection surface 92 at a prescribed position of an outer side surface as described below are formed at the end wall 90*h*.

The partition member 90 has a width W1 in a short direction very slightly shorter than the distance L2 between the tip surfaces 81*a*, 81*b* for allowing the partition member 90 sliding in a vertically downward direction without stacking between the tip surfaces 81*a*, 81*b* of the restriction ribs 81, 82 of the container body 70. A pair of flexible members 93, 94 are arranged at outer peripheral portions of the partition member 90 as to project toward the right and left vertical frames 70*a*, 70*b* of the container body 70 from the lower portions of the right and left upper side wall portions 90*a*, 90*b* in a way that respective tips extend obliquely upper directions by a prescribed amount. Those flexible members 93, 94 are formed symmetrically with respect to a virtual center plane (parallel to Z-Y plane) in the width direction (X-axis direction) of the partition member 90. Those flexible members 93, 94 serve as pawl members of the ratchet mechanism to restrict movements of the partition member 90.

The flexible members 93, 94 are elastically transformable members, and are formed of such as, e.g., a PET (polyethylene terephthalate) film having a thickness of 0.1 to 0.2 mm, extending over the entire range of the partition member 90 as shown in FIG. 8. The flexible members 93, 94 are formed so that open ends 93*a*, 94*a* project upward with an angle θ2 with respect to the horizontal plane as shown in FIG. 11. The inclined angle θ2 is set, with respect to the inclined angle θ1, to as follows:

$$\theta 2 \geq \theta 1$$

As shown in FIG. 8, in a state that the projected open ends 93*a*, 94*a* of the flexible members 93, 94 are not bent, an outmost width of the partition member 90 in the horizontal direction, as a distance between the ends, is set to W2, respective sizes have to be set to satisfy the following relation.

$$W2 \geq L1 \geq L2 \geq W1$$

Accordingly, as shown in FIGS. 10, 11, it is structured that the respective projected open ends 93*a*, 94*a* of the flexible members 93, 94 are always in slidably close contact with the inner walls of the container body 70.

It is to be noted that the light reflection surface 92 arranged at the end wall 90*h* of the partition member 90 is positioned to face the transparent window 83 formed at the side frame 70*e* (see FIG. 3) of the container body 70 when the partition member 90 is moved to the bottommost end along the inner wall of the container body 70 as described below.

The toner containing chamber 71 is a chamber formed on a lower side inside the container body 70, and contains unused toner 4. The toner supply opening 72 is formed at the bottom 70*d* of the container body 70 formed in a half cylindrical shape, and is formed to overlap the toner receiving opening 52 of the developing device 10 when the toner cartridge 5 is attached to the developing device 10. The toner 4 in the toner containing chamber 71 is supplied to the toner reservoir 53 (see FIG. 6) in the developing device 31 via the toner supply opening 72 and the toner receiving opening 52.

The supply opening lever 73 (see FIG. 7) is structured of a cylindrical frame 73*a* disposed rotatably in sliding the inner wall of the bottom 70*d* in the half cylindrical shape across the longitudinal direction of the toner containing chamber 71, and a control lever portion 73*b* formed at one end in being exposed to the exterior of the toner containing chamber 71 (see FIG. 7). With the supply opening lever 73, an opening 73*c* is formed at a portion of the cylindrical frame 73*a*, and the toner supply opening 72 is opened to communicate the toner containing chamber 71 by pivotally moving the supply opening lever 73 in a prescribed direction. With this operation, the unused toner 4 can be supplied to the developing device 10 from the toner cartridge 5.

The toner stirring bar 74 is formed rotatably in the toner containing chamber 71 for stirring and conveying the toner 4. The toner stirring bar 74 is structured of a rotary axis 74*a* made of a stiff material, and a flexible film 74*b* made of such as, e.g., a PET film having a radial length extending toward the inner wall of the cylindrical bottom 70*d* from the rotary axis 74*a* in slidably contacting the inner wall and an axial length extending the whole length in the longitudinal direction of the toner containing chamber 71. The toner stirring bar 74 is rotated by a drive system not shown around the rotary axis 74*a* as a center.

It is to be noted that the toner stirring bar 74 is not limited to the above structure, and can be formed with a non-flexible thin plate radially extending from the rotary axis 74*a* to the inner wall of the cylindrical frame with a length not contacting the inner wall of the cylindrical frame with a slight margin in lieu of the flexible film 74*b*.

The waste toner containing chamber 75 is a chamber formed on an upper side inside the container body 70 by means of the partition member 90, and the waste toner 34 is contained in the waste toner containing chamber 75. The waste toner discharge unit 43 (see FIG. 4) of the developing device 10 is fitted into the waste toner intake opening 76 when the toner cartridge 5 is attached to the developing device 10, and the waste toner 34 discharged from the waste toner discharge opening 45 drops to the waste toner containing chamber 75 from the dropping opening 76*a* coupled to the waste toner intake opening 76. The waste toner intake opening 76 and the dropping opening 76*a* are formed in a wall corresponding to the region of the waste toner containing chamber 75 at a top portion of the container side surface lid 78.

An inner diameter of the waste toner intake opening 76 is nearly equal to or very slightly larger than the outer diameter of the waste toner discharge unit 43 (see FIG. 4) of the developing device 10, and when the toner cartridge 5 is attached to the developing device 10, the waste toner discharge unit 43 is structured to be inserted into the waste toner intake opening 76.

The waste toner conveyance spiral 77 is disposed below the dropping opening 76*a* for the waste toner 34 located in the waste toner containing chamber 75 as shown in FIG. 7, 9, and is provided for conveying the waste toner 34 dropped to the waste toner containing chamber 75 from the dropping opening 76*a* toward a back side in the longitudinal direction in the waste toner containing chamber 75 (or namely the minus direction of Y-axis). The waste toner conveyance spiral 77 prevents the waste toner 34 dropped to the waste toner containing chamber 75 from remaining around the dropping opening 76*a* and from being clogged there. The waste toner conveyance spiral 77 is rotated by the same drive system as that for the toner stirring bar 74.

As shown in FIG. 10, a guide plate 70*f* extending downward from a center in the width direction (X-axis direction) is formed as to extend in the longitudinal direction as shown in FIG. 9 at the horizontal frame 70*c* of the container body 70. One end of the guide plate 70*f* (minus side of Y-axis) is fitted into the slit 91 formed in the end wall 90*h* of the partition member 90, thereby guiding the partition member 90 moving smoothly in the vertically downward direction. The lower end of the guide plate 70*f* is formed near the waste toner conveyance spiral 77, thereby restricting the free end of the rotating cantilevered waste toner conveyance spiral 77 from bending back upward as described above.

The container side surface lid 78 shields one sides of the toner containing chamber 71 and the waste toner containing chamber 75, and prevents the unused toner 4 in the toner containing chamber 4 from leaking out of the chamber and the waste toner 34 in the waste toner containing chamber 75 from leaking out of the chamber.

The sealing members 95, 96 are formed of, such as, e.g., a sponge. The sealing member 95 is arranged along the inner wall of the side frame 70*e* on a downstream side in the waste toner conveyance direction in the longitudinal direction of the container body 70 whereas the sealing member 96 is arranged along the inner wall of the container side surface lid 78, and both members 95, 96 are secured respectively over regions covering the moving range of the partition member 90 as described below.

Those sealing members 95, 96 are designed to have respective thicknesses as to fill the gaps in an airtight manner between the side surface of the partition member 90 and the inner wall of the container body 70 and between the side surface of the partition member 90 and the inner wall of the container side surface lid 78 with respect to the longitudinal direction (Y-axis) of the toner cartridge 5. Thickness, material, pushed amount, etc of the sealing members 95, 96 are to be determined properly in care of not disturbing sliding movements of the partition member 90 due to such as frictional overloads in accompany with pressure.

It is to be noted that the sealing member 95 securely arranged along the inner wall surface of the side frame 70*e* is provided with a through hole in a range corresponding to the transparent window 83 of the container body 70, thereby allowing light transmitting between the transparent window 83 and the light reflection surface 92.

Operation of the partition member 90 in accompany with containments of the waste toner 34 in the toner cartridge 5 having the structure described above, will be described below.

Figure 12:
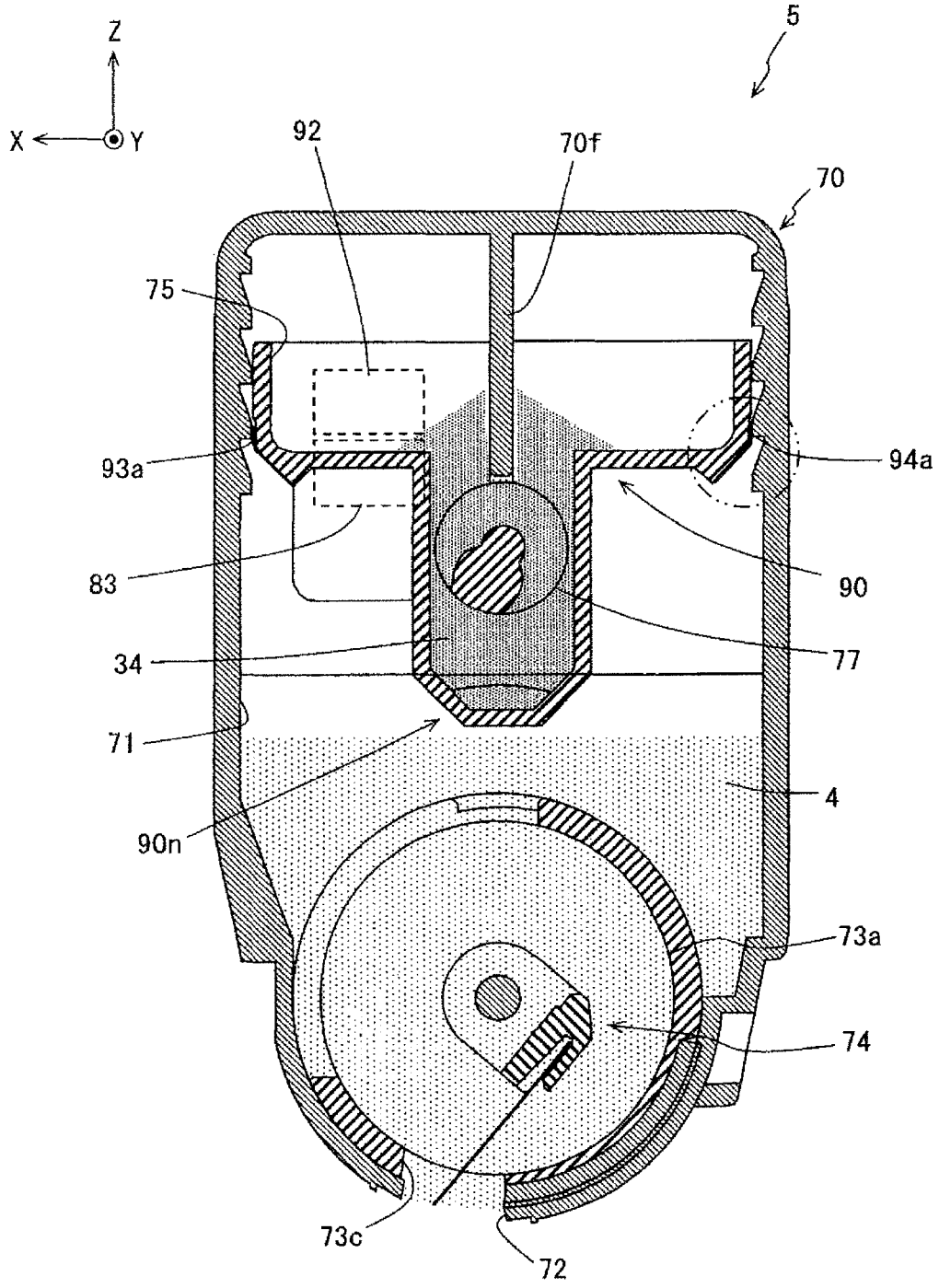
FIG. 12 is a cross section showing the toner cartridge in a stage that the toner is used in a certain amount in comparison with the stage shown in FIG. 10.
Figure 13:
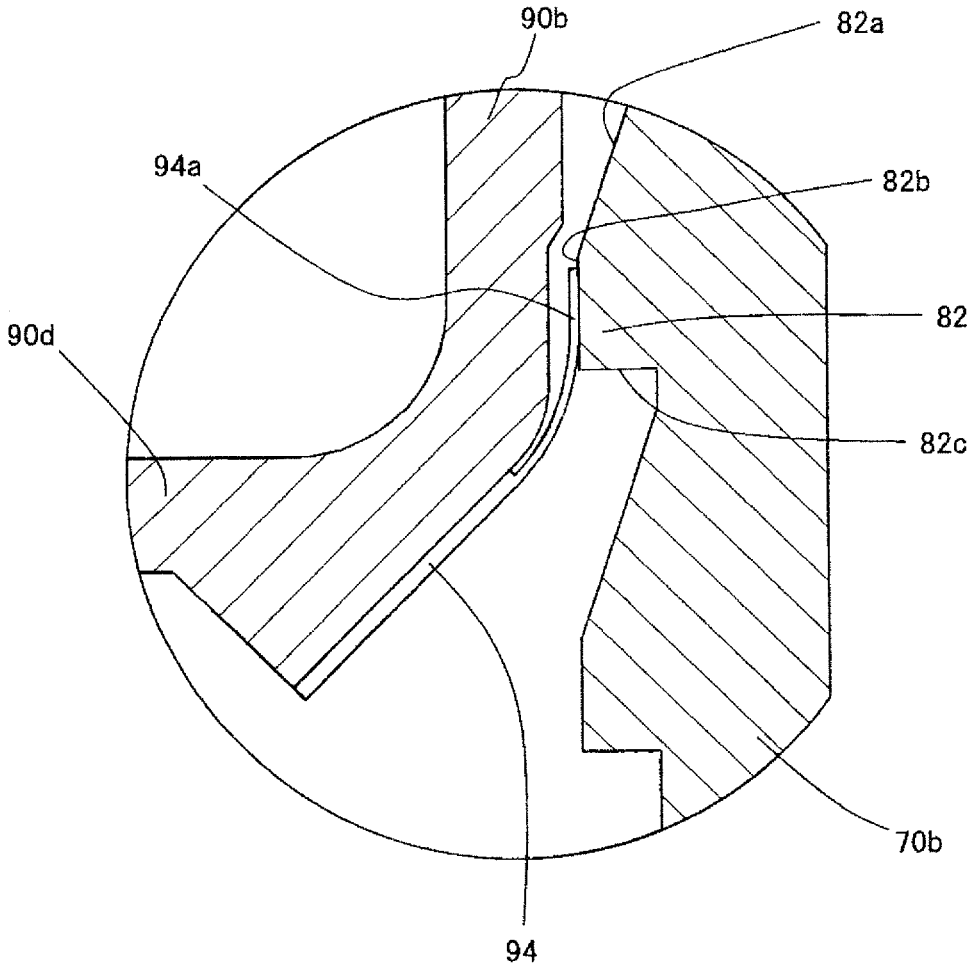
FIG. 13 is an enlarged view showing a portion circled with a double dotted chain line in FIG. 12.
Figure 14:
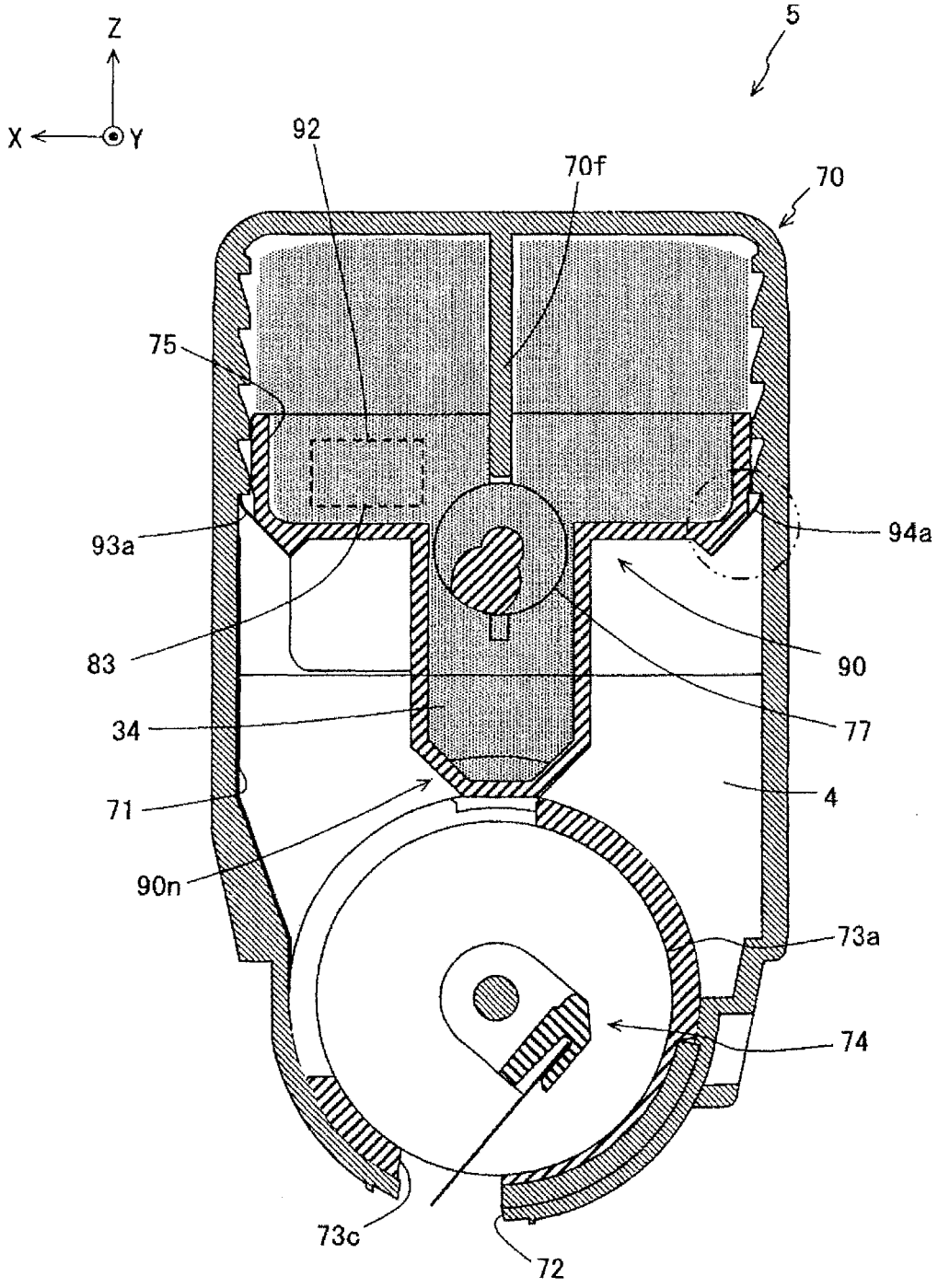
FIG. 14 is a cross section showing the toner cartridge where the toner is used as a final stage.
Figure 15:
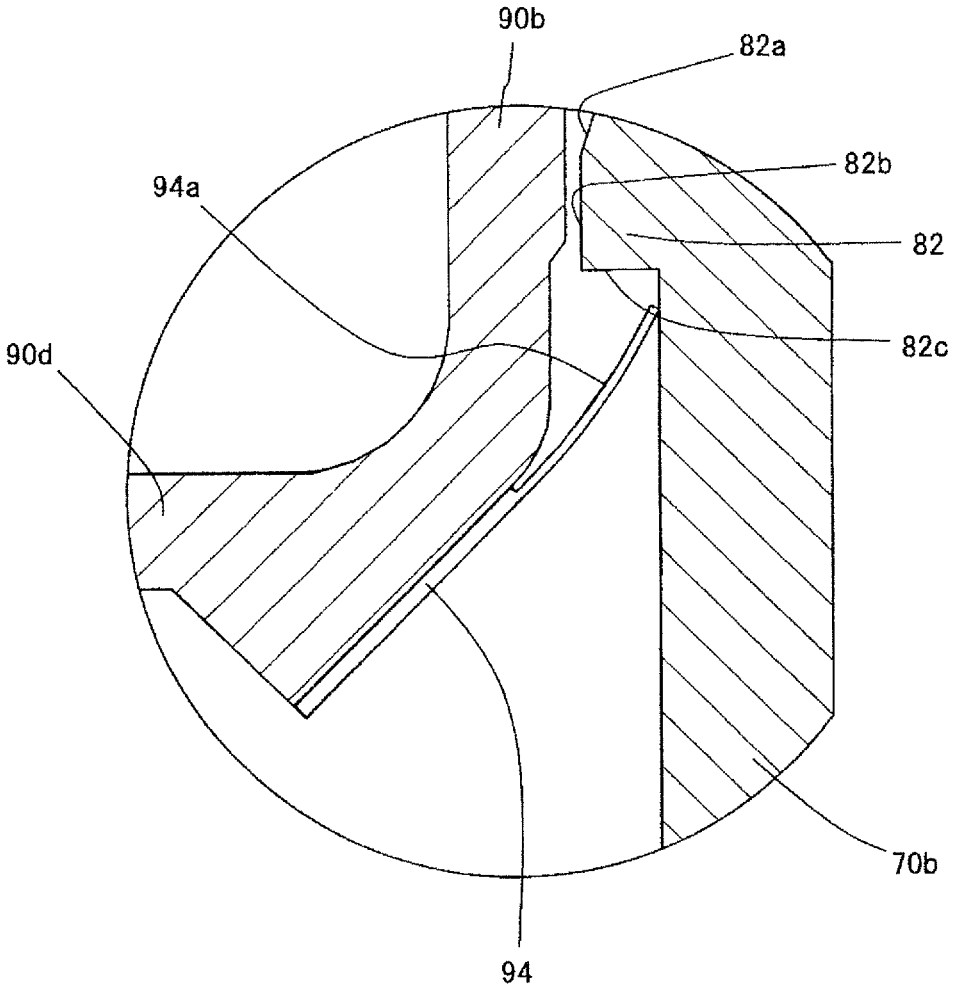
FIG. 15 is an enlarged view showing a portion circled with a double dotted chain line in FIG. 14.

FIG. 10, FIG. 12, and FIG. 14 are cross sections showing the toner cartridge 5 attached to the developing device 10 containing the toner 4 with movements of the partition member 90 moving according to the used amount of the toner 4. FIG. 11 is an enlarged view showing a portion circled with a double dotted chain line in FIG. 10; FIG. 13 is an enlarged view showing a portion circled with a double dotted chain line in FIG. 12; FIG. 15 is an enlarged view showing a portion circled with a double dotted chain line in FIG. 14. It is to be noted that FIG. 6 and FIG. 10 show the state that the partition member 90 is located at the topmost position.

The partition member 90 movable downward in the vertical direction in the container body 70 is made to move downward according to a balance from the self-weight, the weight of the waste toner 34 contained in the waste toner containing chamber 75, downward force (gravity direction) from exertion of the waste toner conveyance spiral 77 described below, resistance receiving the unused toner 4 contacting the toner contact portion 90*n*, engagement from opposing elastic force occurring where the flexible members 93, 94 are bent on the slopes 81*a*, 82*a* of the restriction ribs 81, 82 of the container body 70, and resistance force due to friction and the like from the sealing members 95, 96 (see FIG. 9) on both sides in the longitudinal direction.

FIG. 10 and FIG. 11 show a state that the partition member 90 stays at the topmost position in an initial stage of use. Where the unused toner 4 is contained at that time in the toner containing chamber 71 in the container body 70 in a state close to the maximum amount, the resistance to the toner contact portion 90*n* from the toner 4 is large, whereas the amount of the waste toner 34 contained in the waste toner containing chamber 75 is small, so that the partition member 90 stays at the topmost position. Accordingly, the volume of the toner containing chamber 71 at that time is the maximum, and the volume of the waste toner containing chamber 75 is the minimum.

FIG. 12 and FIG. 13 show a state in which, from the state shown in FIG. 10, the unused toner 4 in the toner containing chamber 71 is consumed, and according to this the toner 4 is discharged from the toner supply opening 72 to make lower the surface position, and in which the waste toner 34 is brought into the waste toner containing chamber 75 to fill the internal space in the toner contact portion 90*n* and further to raise a center portion of the waste toner containing chamber 75 as on the toner contact portion 90*n*.

At that time, the waste toner 34 dropped from the dropping opening 76*a* (see FIG. 9) onto an end of the waste toner conveyance spiral 77 is accumulated sequentially to the back side (minus direction) by the waste toner conveyance spiral 77 and to a mountain shape upwardly. Because the width of the inner space of the toner contact portion 90*n* is substantially equal to the diameter of the waste toner conveyance spiral 77, the waste toner 34 below the waste toner conveyance spiral 77 is easily collected, thereby exerting pressure to the partition member 90 in the downward direction. The waste toner conveyance spiral 77 receives upward force according to reaction or drag to the pressure, so that the free end tends to be bent upward, but the guide plate 70*f* disposed nearby suppresses this bending.

On the other hand, the toner contact portion 90*n* may not receive any resistance occurring at the initial stage of use from the unused toner 4, because the surface position of the toner 4 is lowered. Accordingly, the force pushing down the partition member 90 (gravity direction) overcomes the resistance force, so that the partition member 90 descends gradually.

When the partition member 90 moves down, as shown in FIG. 11, FIG. 13, FIG. 15, for example, on the right side of the toner cartridge 5, the open end 94*a* of the flexible member 94 of the partition member 90 moves in repeating transformation in which the open end is bent to the maximum extent when sliding over the tip surface 82*b* and is bent back to the inner wall of the right vertical frame 70*b* upon reaching the lower end surface 82*c*, at each of the restriction ribs 82 of the container body 70.

Therefore, when the flexible member 94 of the partition member 90 passes by one of the restriction rib 82 of the container body 70 and is bent back, the partition member 90 cannot move upward from the incident restriction rib 82. This operation is also done in substantially the same way as with the flexible member 93, the restriction rib 81, the left vertical frame 70*a* on the left side of the toner cartridge 5.

FIG. 14 and FIG. 15 show a state that, at the last stage of use, the unused toner 4 in the toner containing chamber 71 located below the partition member 90 is consumed up and is made disappeared, and that the waste toner 34 is contained in the maximum amount in the waste toner containing chamber 75 located above the partition member 90.

At that time, the partition member 90 is positioned to the bottommost position in a movable range in the container body 70, and therefore, the volume of the toner containing chamber 71 becomes the minimum at that time whereas the volume of the waste toner containing chamber 75 becomes the maximum. It is to be noted that the partition member 90 is restricted from further moving downward by contacting the toner contact portion 90*n* of the partition member 90 with the cylindrical frame 73*a* of the supply opening lever 73.

The light reflection surface 92 formed in the partition member 90 at that time positionally coincides to the transparent window 83 formed in the container body 70. With this operation, light emission out of a light reflection type sensor, not shown, arranged on a body side of the image forming apparatus 1 as to face the transparent window 83 of the toner cartridge 5 is received again at the light reflection type sensor upon reflected at the light reflection surface 92 in passing through the transparent window 83, and it can be detected that the position of the partition member 90 in the container body 70 is at the bottommost position, or in other words, that the toner cartridge 5 is in the used state.

As described above, according to the toner cartridge of this embodiment, the flexible members 93, 94 of the partition member 90 move in repeating bending and bending back one by one along the restriction ribs 81, 82 of the container body 70 where the partition member 90 moves downward according to containing the waste toner 34. The partition member 90 therefore cannot move upward from the position at which the flexible members 93, 94 of the partition member 90 are bent back in exceeding each of the restriction ribs 81, 82 of the container body 70.

After the volume of the waste toner containing chamber 75 is enhanced by moving the partition member 90 downward once (gravity direction), any movement upward is restricted, which is otherwise reducing the volume of the waste toner containing chamber 75 again due to such as external force or impact, thereby preventing the waste toner from pushed back, so that the developer container can provide comfortable maintenances.

In the above embodiments, the terms "up," "down," "left," "right," "front," and "back" are used, but those are chosen for a convenient purpose, and are not limiting absolute positional relationships in a state that the toner cartridge is arranged.

In this embodiment, the multicolor printer is used for an example of the image forming apparatus, but this invention is applicable to monochrome printers, photocopiers, facsimile machines, and MFPs (Multifunction Peripherals) having those functions.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A developer container comprising:

a developer containing unit having a developer containing chamber for containing an unused developing agent and a waste developer containing chamber for containing a waste development agent;

a partition member partitioning the developer containing chamber and the waste developer containing chamber; and a moving restricting member permitting the partition member moving from a side of the waste developer containing chamber to a side of the developer containing chamber and restricting the partition member moving from the side of the developer containing chamber to the side of the waste developer containing chamber, wherein the waste developer containing chamber includes a conveyance spiral member extending in a longitudinal direction of the waste developer containing chamber, wherein the partition member has a recess containing the conveyance spiral member, and wherein the partition member moves downwardly from the side of the waste developer containing chamber to the side of the developer containing chamber according to the weights of the partition member and the waste developer agent.

2. The developer container according to claim 1, wherein the moving restricting member includes a serrated portion formed on an inner wall of the developer containing unit, and a projecting portion engageable with the serrated portion.

3. The developer container according to claim 2, wherein the serrated portion is formed with plural restriction ribs arranged in parallel extending in one direction, each rib having a slope slant with respect to the inner wall of the developer containing unit.

4. The developer container according to claim 3, wherein the projecting portion has a projecting angle angled from a horizontal plane, substantially equal to or less than an angle of the slope slant angled from the horizontal plane.

5. The developer container according to claim 2, wherein the projecting portion projects toward the inner wall and is formed of a flexible member elastically transforming as sliding along a slope of each rib of the serrated portion.

6. The developer container according to claim 2, wherein the partition member moves in the gravity direction and moves according to the self-weight of the partition member and to a weight of the waste developer agent.

7. The developer container according to claim 1, wherein the partition member stops moving when contacting the developer agent remaining in the developer containing chamber.

8. An image forming unit comprising the developer container according to claim 1.

9. An image forming apparatus comprising the developer container according to claim 1.

10. A developer container comprising:

a developer containing unit formed with a first chamber having a first space for containing a first developing agent and with a second chamber having a second space for containing a second developing agent; and a partition member partitioning the spaces of the first and second chambers, the partition member movable inside the developer containing unit in a way to decrease the first space and to increase the second space, wherein the partition member is restricted from moving in a direction decreasing the first second space and increasing the first space, and wherein the second chamber includes a conveyance spiral member extending in a longitudinal direction of the second chamber, wherein the partition member has a recess containing the conveyance spiral member, and wherein the partition member moves downwardly from the side of the second chamber to the side of the first chamber according to the weights of the partition member and the waste developer agent.

11. The developer container according to claim 10, wherein the partition member is moved according to an amount of the second developing agent brought into the second space.

12. The developer container according to claim 10, wherein the partition member is restricted from moving upward by means of a ratchet mechanism formed at the partition member and the developer containing unit.

13. The developer container according to claim 12, wherein the ratchet mechanism includes a pawl member on one side of the partition member and the developer containing unit, and a rack member on the other side of the partition member and the developer containing unit.

14. The developer container according to claim 13, wherein the rack member is formed of a serrated portion formed on an inner wall of the developer containing unit, and the pawl member is formed from a projecting portion engageable with the serrated portion.

15. An image forming unit comprising the developer container according to claim 10.

16. An image forming apparatus comprising the developer container according to claim 10.

* * * * *